US010646791B2

(12) United States Patent
Semling

(10) Patent No.: US 10,646,791 B2
(45) Date of Patent: May 12, 2020

(54) TOY BUILDING BRICK SYSTEM

(71) Applicant: Brian's Toys Inc., Fountain City, WI (US)

(72) Inventor: Brian Semling, Fountain City, WI (US)

( * ) Notice: Subject to any disclaimer, the term of this patent is extended or adjusted under 35 U.S.C. 154(b) by 0 days.

(21) Appl. No.: 15/987,043

(22) Filed: May 23, 2018

(65) Prior Publication Data

US 2019/0358557 A1 Nov. 28, 2019

(51) Int. Cl.
*A63H 33/08* (2006.01)
*A63H 33/06* (2006.01)

(52) U.S. Cl.
CPC ..... *A63H 33/086* (2013.01); *A63H 33/062* (2013.01); *A63H 33/067* (2013.01)

(58) Field of Classification Search
CPC ..... A63H 33/08; A63H 33/04
See application file for complete search history.

(56) References Cited

U.S. PATENT DOCUMENTS 4,823,532 A * 4/1989 Westerburgen ..... A63H 33/08 446/122
5,000,713 A * 3/1991 Cheng ..... A63H 33/06 273/160
5,391,103 A * 2/1995 Mak ..... A63H 33/06 446/124
D359,315 S * 6/1995 Tacey ..... D21/499
5,924,906 A * 7/1999 Grafton ..... A63H 33/10 411/339
6,162,108 A * 12/2000 Frederiksen ..... A63H 33/086 446/102
D455,183 S * 4/2002 Barazani ..... D21/499
6,506,091 B1 * 1/2003 Garpow ..... A63H 33/08 206/216
6,679,780 B1 * 1/2004 Shih ..... A63F 9/1204 273/156
6,736,691 B1 * 5/2004 Bach ..... A63H 33/101 446/128
D566,201 S * 4/2008 Glickman ..... D21/484
D580,995 S * 11/2008 Chun ..... D21/499
8,888,552 B2 * 11/2014 Wizenberg ..... A63H 33/086 446/102
2008/0160875 A1 * 7/2008 Leicht ..... A63F 9/12 446/124
2009/0298382 A1 * 12/2009 Ochi ..... A63H 33/062 446/121
2010/0210173 A1 * 8/2010 Maggiore ..... A63H 33/062 446/125
2011/0039474 A1 * 2/2011 Bruder ..... A63H 33/101 446/124
2013/0312357 A1 * 11/2013 Lin ..... A63H 33/106 52/589.1
2014/0057523 A1 * 2/2014 Leicht ..... A63H 33/106 446/124

* cited by examiner

*Primary Examiner* — Eugene L Kim
*Assistant Examiner* — Christopher Glenn

(57) ABSTRACT

A toy building brick system includes a brick which has an outer surface including a plurality of outer walls. A male peg is attached to one of the outer walls. The male peg is configured to engage a female connector and includes a post having a terminal end. The terminal end has an outer peripheral edge. The outer peripheral edge has a notch positioned therein. The notch faces an adjacent edge of the outer wall attached to the male peg to prevent adjacent male pegs of adjacent bricks from abutting in such a manner that the male pegs bias the adjacent bricks apart from each other.

20 Claims, 23 Drawing Sheets

TOY BUILDING BRICK SYSTEM

CROSS-REFERENCE TO RELATED APPLICATIONS

This application is a continuation in part of U.S. patent application Ser. No. 15/852,832, filed on Dec. 22, 2017.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to toy building brick devices and more particularly pertains to a new toy building brick system for allowing a user thereof to create cubic type patterns and provide for coverings therefore.

BRIEF SUMMARY OF THE INVENTION

An embodiment of the disclosure meets the needs presented above by generally comprising a base brick having a cubic shape such that the base brick comprises six outer walls. The base brick has an open interior and each of the outer walls comprises a female receiver such that six female receivers are formed in the base brick. In this manner, the base brick defines an all-female brick. A plurality of inserts is provided and each of the inserts is removably engaged with one of the female receivers such that an outer surface of each of the inserts faces outwardly of the open interior.

In another embodiment, a brick is provided which has an outer surface including a plurality of outer walls. A male peg is attached to one of the outer walls. The male peg is configured to engage a female connector and includes a post having a terminal end. The terminal end has an outer peripheral edge. The outer peripheral edge has a notch positioned therein. The notch faces an adjacent edge of the outer wall attached to the male peg to prevent adjacent male pegs of adjacent bricks from abutting in such a manner that the male pegs bias the adjacent bricks apart from each other There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

Figure 22:
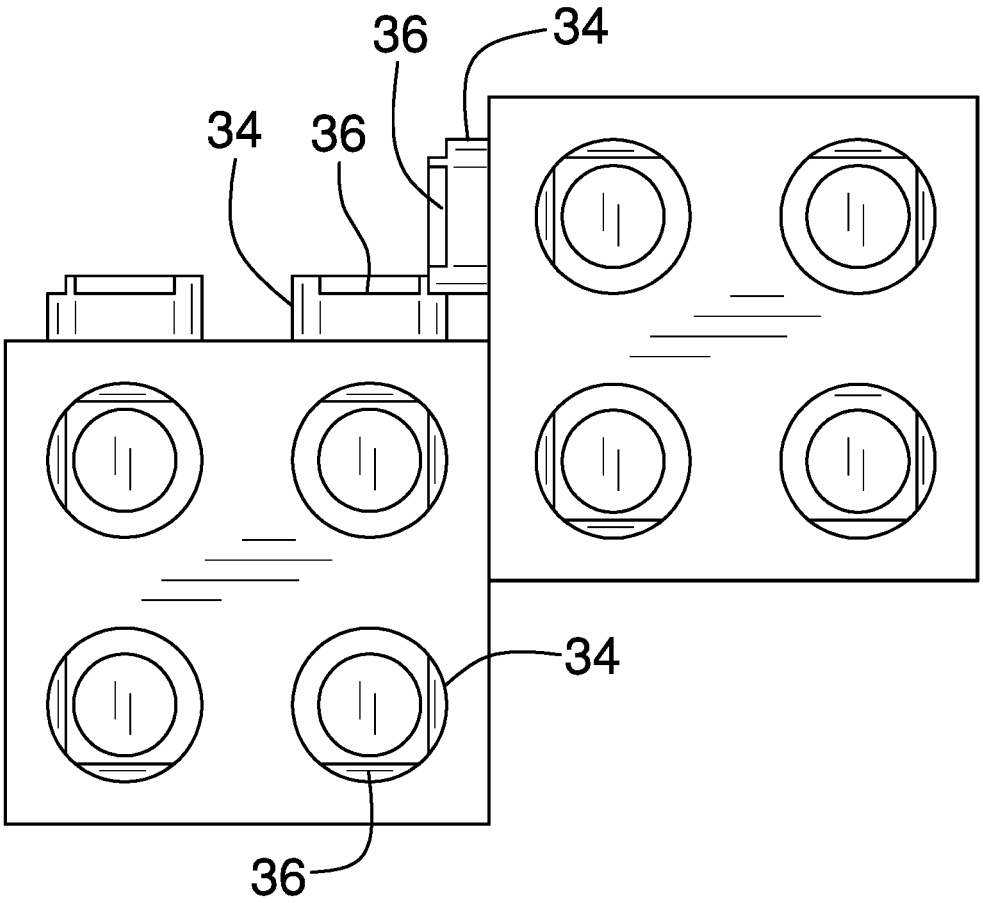
FIG. 22 is a side view of an embodiment of the disclosure.
Figure 33:
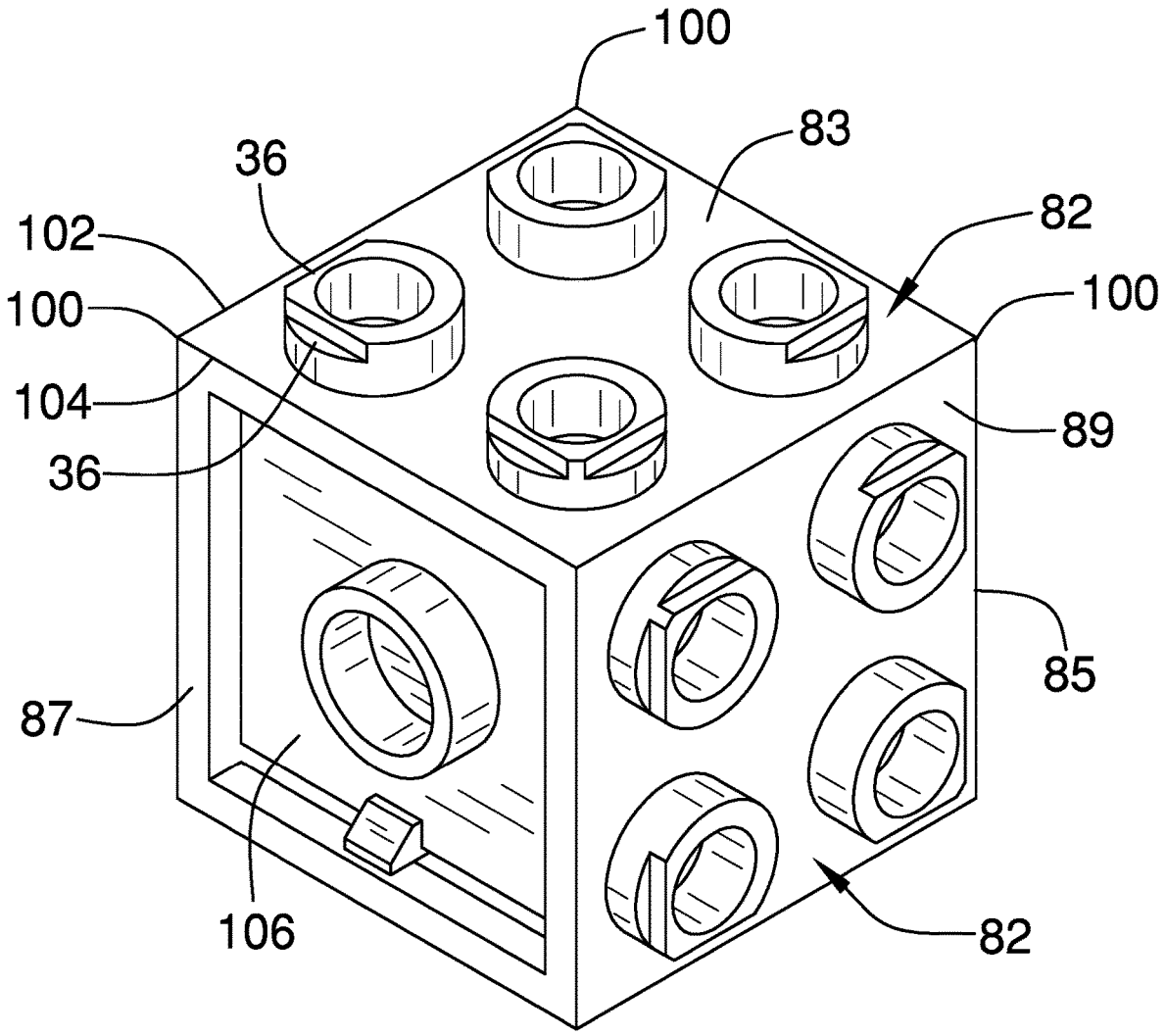

FIG. 33 perspective rear view of a brick shown in FIG. 22 of the disclosure.

Figure 34:
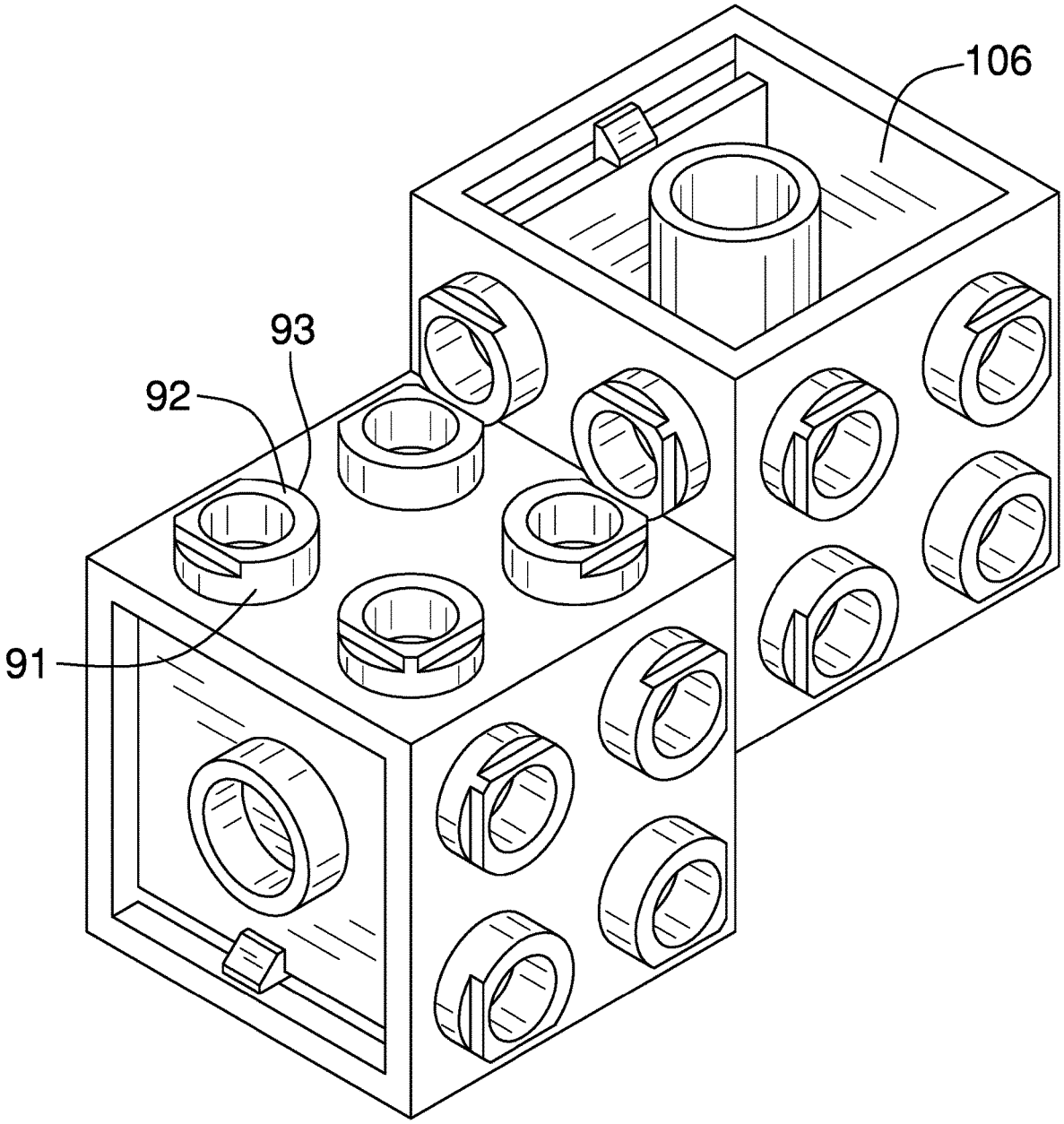

FIG. 34 a perspective left view of FIG. 22 of the disclosure.

Figure 35:
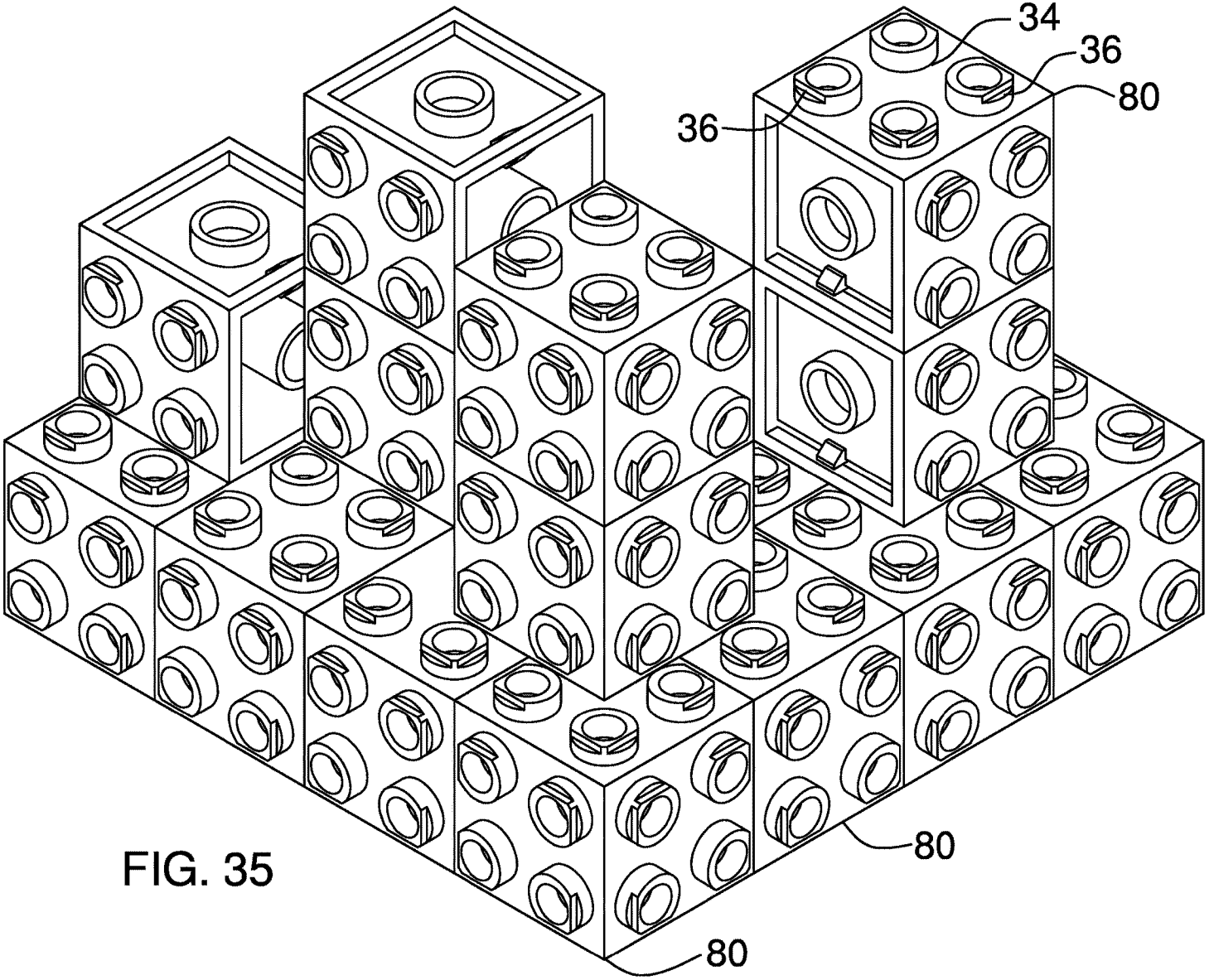

FIG. 35 a perspective in-use view of a plurality of the bricks shown in FIG. 22.

DETAILED DESCRIPTION OF THE INVENTION

With reference now to the drawings, and in particular to FIGS. 1 through 35 thereof, a new toy building brick device embodying the principles and concepts of an embodiment of the disclosure and generally designated by the reference numeral 10 will be described.

As best illustrated in FIGS. 1 through 35, the toy building brick system 10 generally comprises a structure and system to be utilized with building brick systems utilizing generally similar structures for frictionally coupling together these structures. Typically these structures comprise interconnecting toy bricks and the systems therefore. These brick systems are ubiquitous in the toy arts and are found in multiple references such as U.S. Pat. No. 3,005,282. Toy bricks of this type may be found, for instance, being sold under the names Lego and Duplo. Lego and Duplo bricks may be analogous to each other generally but vary in size with respect to each other. More particularly, the Duplo toy bricks includes larger features than Lego toy bricks which allows Duplo type bricks to be used more easily by small children.

The system 10 herein includes a base brick 12 having a cubic shape such that the base brick comprises six outer walls 14. The base brick 12 has an open interior and each of the outer walls 14 comprises a female receiver 15 such that six female receivers 15 are formed in the base brick 12. More specifically, each of the outer walls 14 includes a panel that has an outer surface 17 and an inner surface 18. The panel has an opening 19 therein extending through the outer 17 and inner 18 surfaces and is centrally located. Though other shapes may be utilized, such as particularly rectangular, more typically the opening 19 will be square shaped and is bounded by a perimeter surface 20. A shoulder 21 is formed in the perimeter surface 20 and extends inward of the opening 19. The shoulder 21 is co-extensive with the perimeter surface 20. The shoulder 21 is spaced from the outer surface 17 to form the female receiver 15 from the outer surface 17 to the shoulder 21. The shoulder 21 may further have an interior edge 22 bounding the opening 19. In particular version of the base brick, as found in FIG. 4, includes an interior being entirely open. Another embodiment, found in FIGS. 1-3, includes internal bracing 23 structure to provide rigidity to the base brick 12 as well as structural support to prevent the base brick 12 from bending or cracking along its outer edges.

A plurality of inserts 26 is provided and each of the inserts 26 is removably engaged with one of the female receivers 15 such that an outer surface 27 of each of the inserts 26 faces outwardly of the open interior of the base brick 12. As shown generally in FIGS. 5-8 and FIGS. 13-14, the inserts 26 each include a plate 28 that has a first side 29, a second side 30 and a perimeter edge 31 wherein the first side 29 defines the outer surface 27. The perimeter edge 31 is abuttable against and frictionally engaged to the perimeter surface 20 of the female receiver 15. More particularly, the plate 28 will have the same shape as the female receiver 15 and therefore will typically have a square shape. The second side 30 is abuttable against the shoulder 21.

Figure 1:
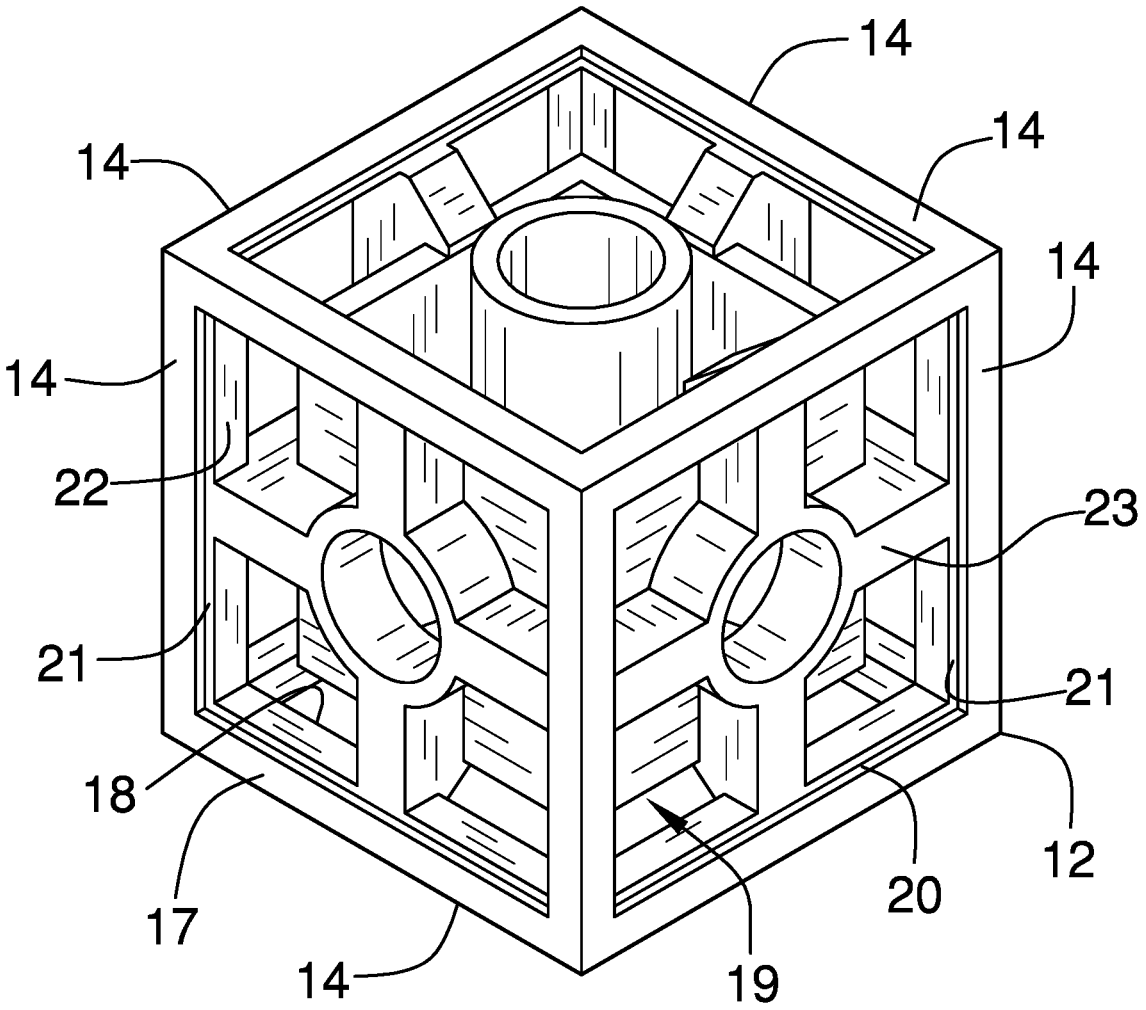
FIG. 1 is a top perspective view of an all-female brick of a toy building brick system according to an embodiment of the disclosure.
Figure 2:
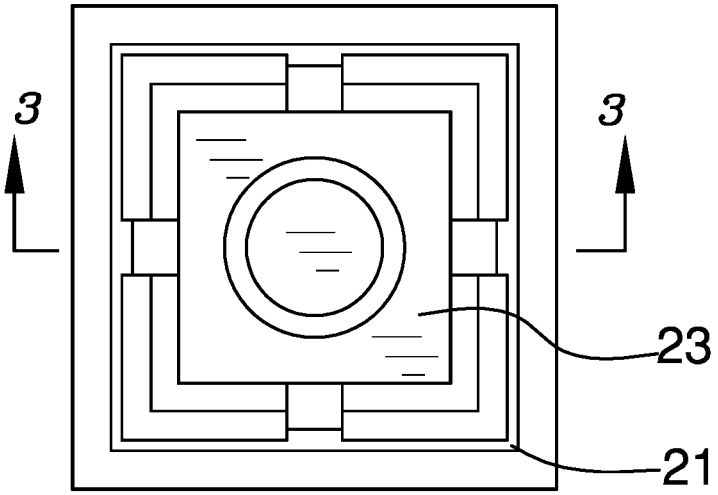
FIG. 2 is a bottom view of an embodiment of the disclosure.
Figure 3:
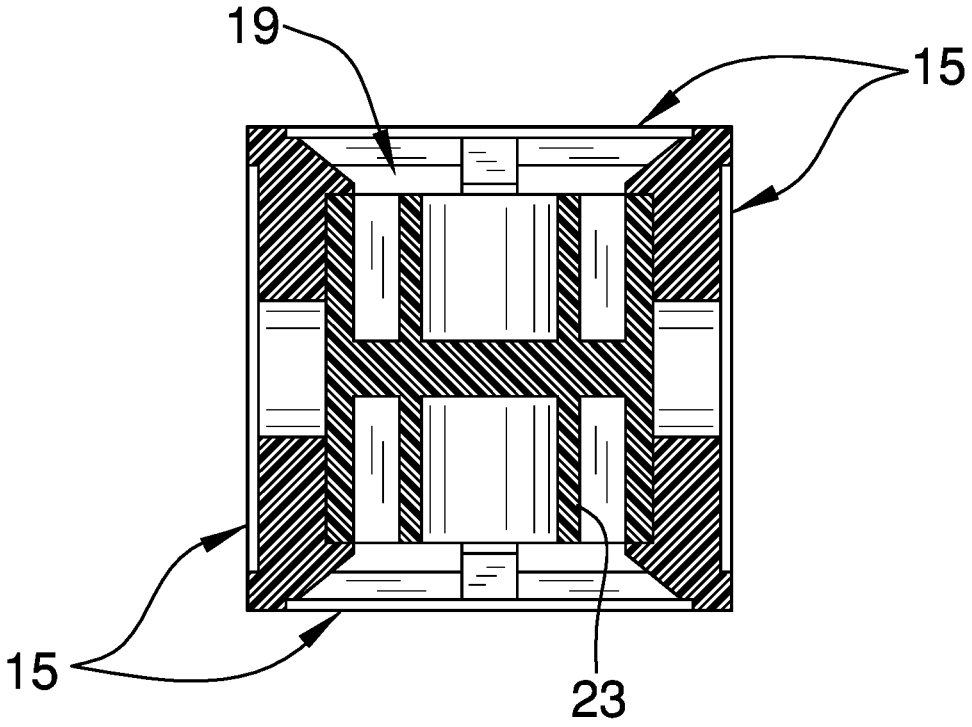
FIG. 3 is a cross-sectional view of an embodiment of the disclosure taken along line 3-3 of FIG. 2.
Figure 4:
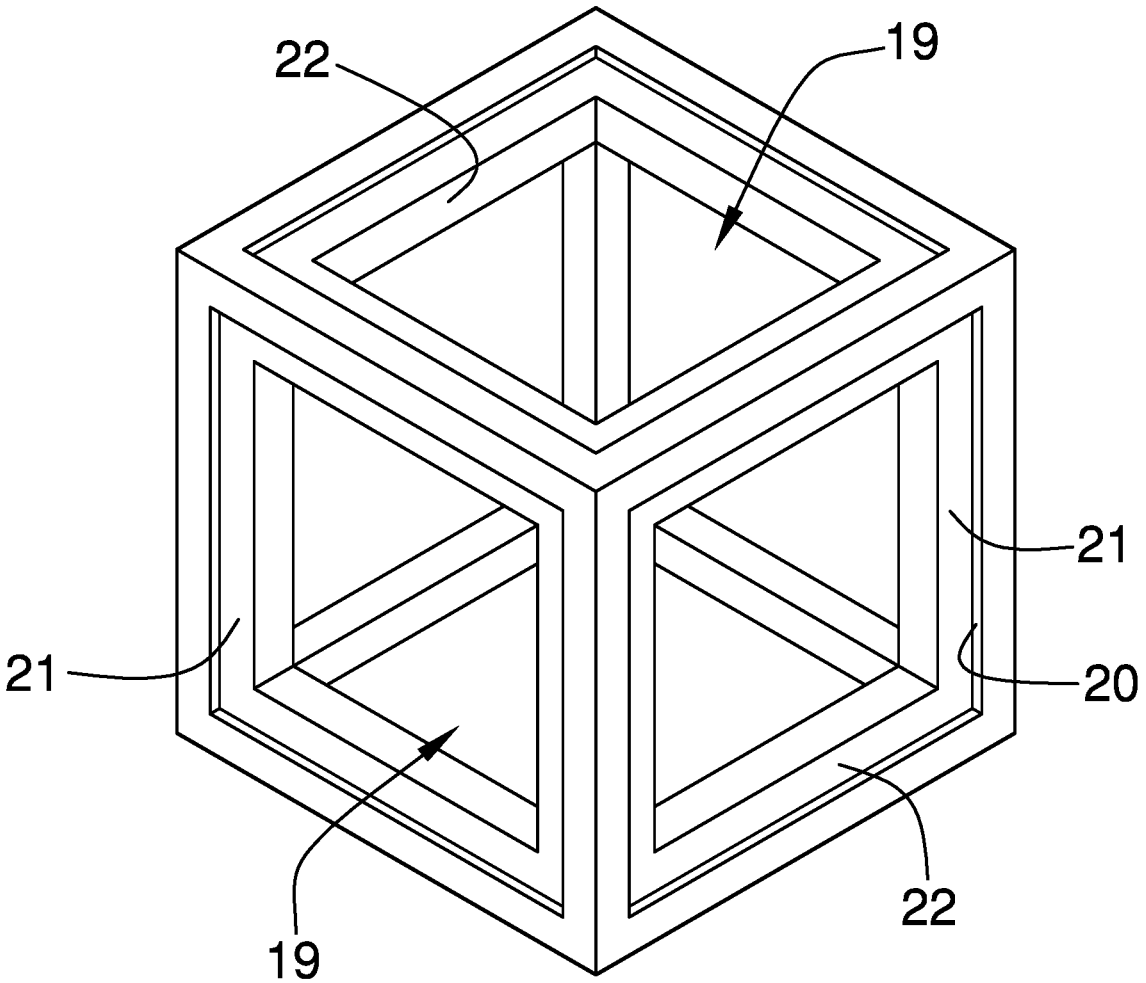
FIG. 4 is a perspective view of another embodiment of an all-female brick of the disclosure.
Figure 5:
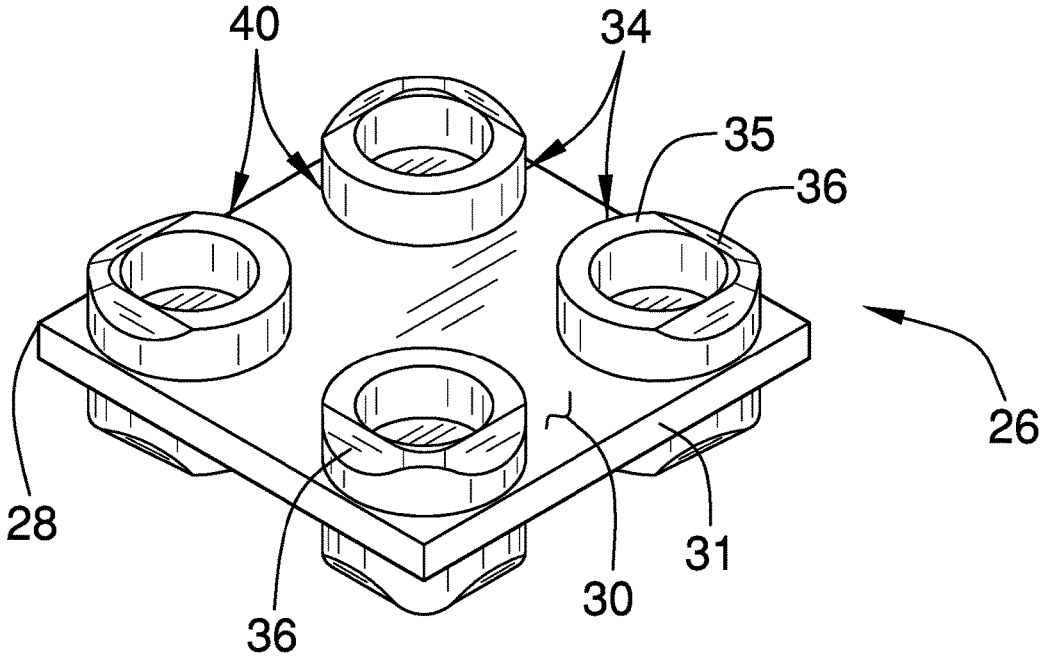
FIG. 5 is a top perspective view of an embodiment of an insert of the disclosure.
Figure 6:
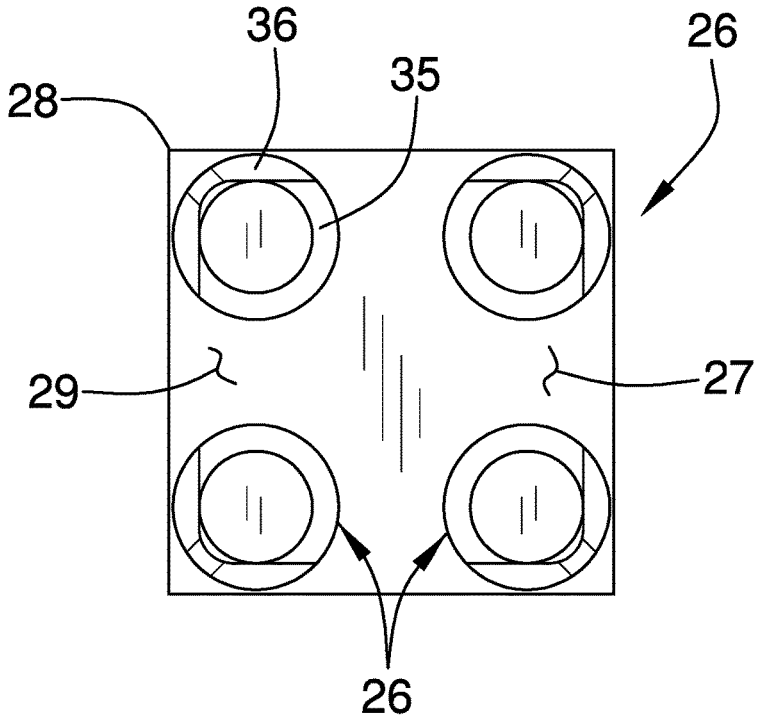
FIG. 6 is a bottom view of an embodiment of FIG. 5 of the disclosure.

A plurality of male pegs 34 may be attached to the second side 30 as shown in FIG. 5. The male pegs 34 frictionally engaging the interior edge 22 of the shoulder 21 and/or the internal bracing 23 found in FIG. 1. Each of the male pegs 34 has a terminal end 35. As can be seen in FIG. 5, the terminal ends 35 may each have notches 36 therein such that the terminal ends 35 are angled downwardly toward adjacent portions of the perimeter edge.

Figure 28:
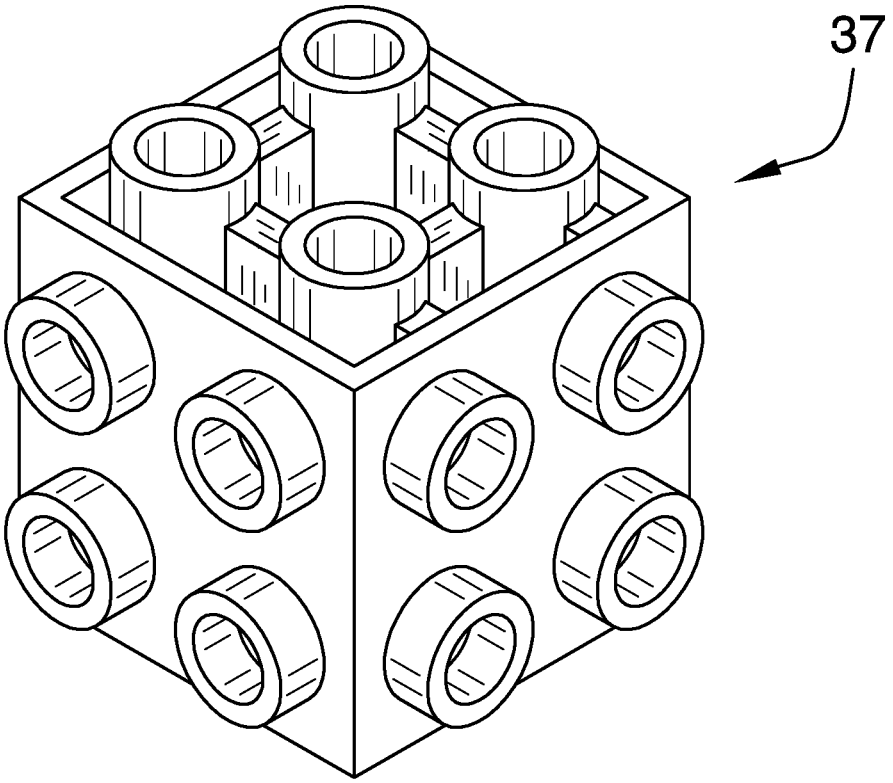
FIG. 28 is a top and front perspective view of an all-male sided brick of the disclosure wherein a bottom and rear perspective view thereof is a mirror image of FIG. 28.

As shown in FIGS. 21, 22, and 31-33, a ledge may be formed by the notches 36. The notches allow for adjacent interaction of male pegs 34 of stacked of adjacent blocks as shown in FIG. 22. The notches 36 may also be utilized to allow a tighter, flusher fit with the perimeter surfaces of the female receivers 15. While not all male pegs 34 of the Figures include notches 36, it should be understood that all or none of the male pegs discussed herein and shown in the Figures may include the notches. This may be particularly true for FIG. 28 depicting an all-male brick 37 having all six sides being male, as opposed to female, couplers. While these male pegs 34 are shown as cylinders, they may also include notches 36.

With more particular respect to FIGS. 21, 22, and 31-35, a brick 80 is provided which has an outer surface 81 wherein the outer surface 81 includes a plurality of outer walls 82. The brick 80 will typically have a length, width and height each being less than 3.0 inches. While the brick 80 may have any shape, the outer walls 82 may include an upper wall 83, a lower wall 84, and a side wall 85 extending between the upper 83 and lower 84 walls. It should be understood that the terms "upper" and "lower" herein are only used for clarification as each brick 80 may be orientated in any direction as determined by the user thereof. The side wall 85 may additionally include a front wall 86, a rear wall 87, a first lateral wall 88 and a second lateral wall 89.

At least one male peg 34 is attached to at least one of the outer walls 82, though two, four or more male pegs 34 may be attached to at least one of the outer walls 82. The male pegs 34 are configured to engage a female connector 106. Each of the male pegs 34 includes a post 91 having a terminal end 92, and each terminal end 92 has an outer peripheral edge 93. As shown, for instance in FIG. 32, the outer peripheral edge 93 has at least one notch 36 therein facing an adjacent edge 98 of the outer wall 82 to which the male peg 34 is attached. As shown in the Figures, each outer peripheral edge 93 may include a pair of notches 36 positioned therein wherein each notch 36 faces an adjacent edge 98 of the outer wall 82 to which is attached to the associated male peg 34. The notches 36 may include a stepped cutout or an angled edge.

More specifically as shown in FIG. 33, the surface having the male pegs 34 thereon may have a rectangular shape and includes four corners 100 wherein each of the corners has one of the male pegs 34 positioned adjacent thereto. One of the notches 36 faces one of a first edge 102 of a pair of adjacent edges 98 of one of the corners 100 and one of the notches 36 faces a second edge 104 of the pair of adjacent edges 98 such that each of the first 102 and second 104 adjacent edges corresponds with one of the notches 36. At least one of the outer walls 82 may comprise a female connector 106 configured to engage a plurality of male pegs 34 from other ones the bricks 80.

As can be seen in the Figures, when bricks are attached together and staggered, as seen in FIG. 34, such that the male pegs 34 are positioned adjacent to each other and are orientated perpendicular to each other, the notches 36 prevent the male pegs 34 from engaging each other and urging the bricks 80 apart. Thus, the notches 36 allow for the tighter fitting together of the bricks 80.

Figure 25:
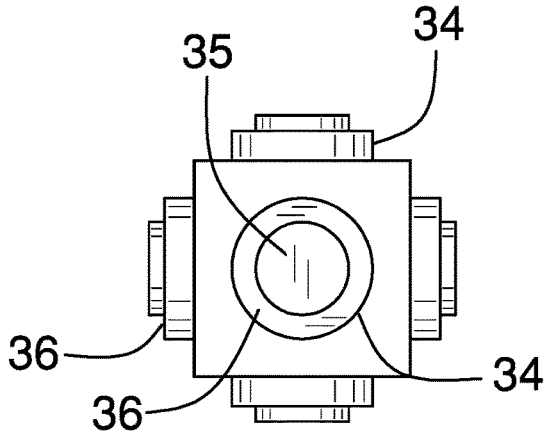
FIG. 25 is a top view of a single peg brick an embodiment of the disclosure.
Figure 26:
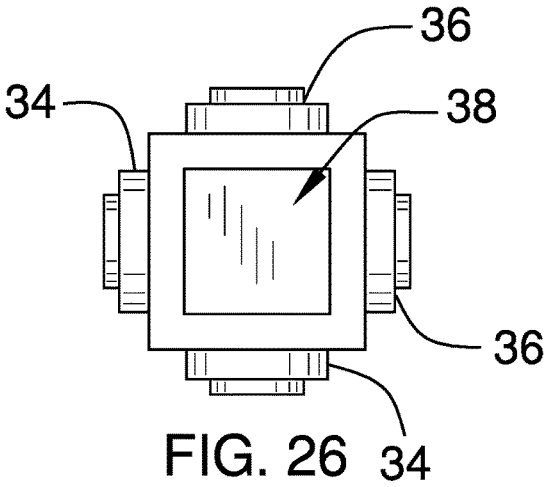
FIG. 26 is a bottom view of FIG. 25 of the disclosure.
Figure 27:
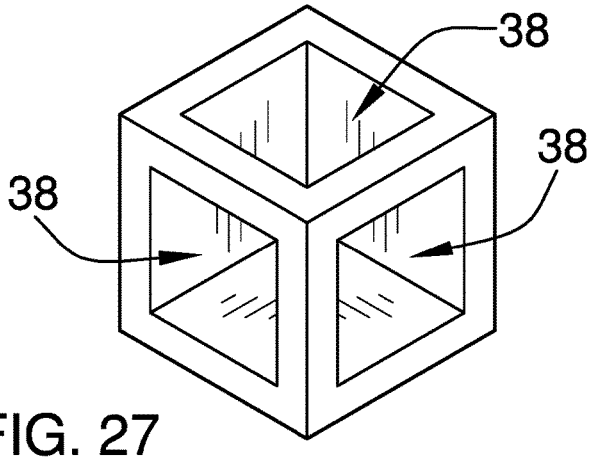
FIG. 27 is a perspective view of a single peg brick of an embodiment of the disclosure.

FIGS. 25-27 include male peg 34 and female receiver combination bricks. The notches 36 in these male pegs 34 may extend completely around each terminal end 35 since with a single male peg 34 its entire perimeter is adjacent to portions of the perimeter edges of the brick to which it is attached. FIG. 25 shows a version of a single pegged sides from the top and FIG. 26 shows the bottom having a female connector 38. Thus, FIGS. 25 and 26 include five male pegged sides and one female connector side. FIG. 27 includes three female connectors 38 and the opposite sides include three male pegs 34 which are not viewable from the depicted view. Also contemplated, but not shown, is an embodiment including two adjacent female connectors 38 and an embodiment including two oppositely positioned female connectors 38.

Figure 13:
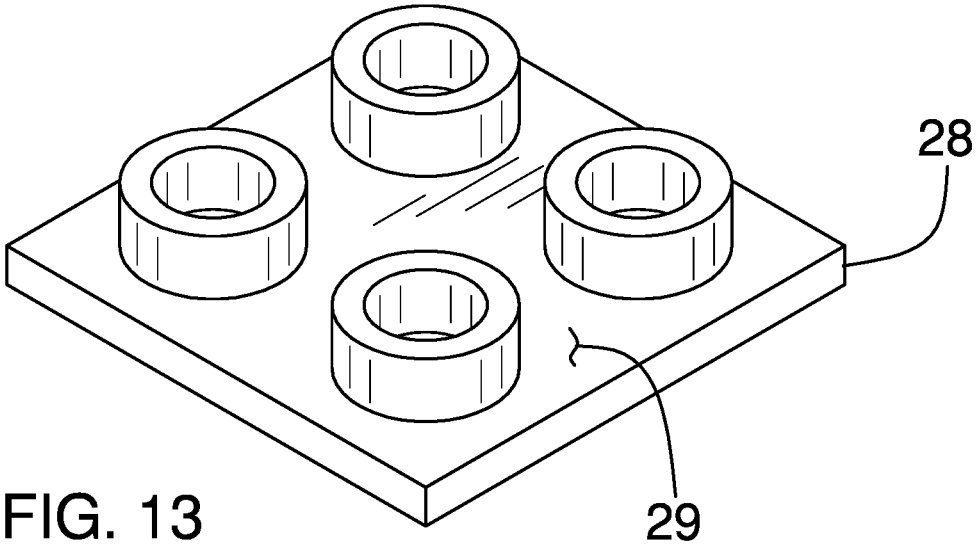
FIG. 13 is a bottom perspective view of an embodiment of an insert of the disclosure.
Figure 14:
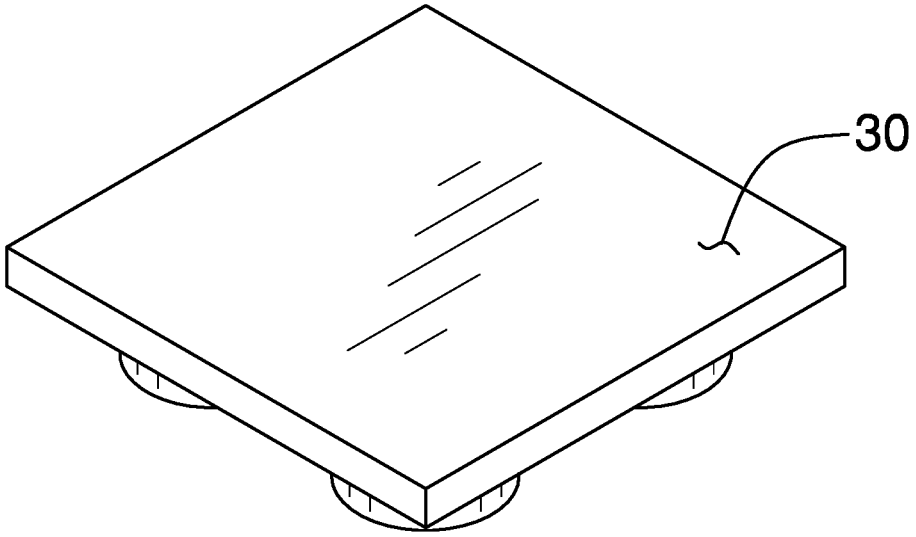
FIG. 14 is a top perspective view of an embodiment of an insert of FIG. 13 of the disclosure.
Figure 15:
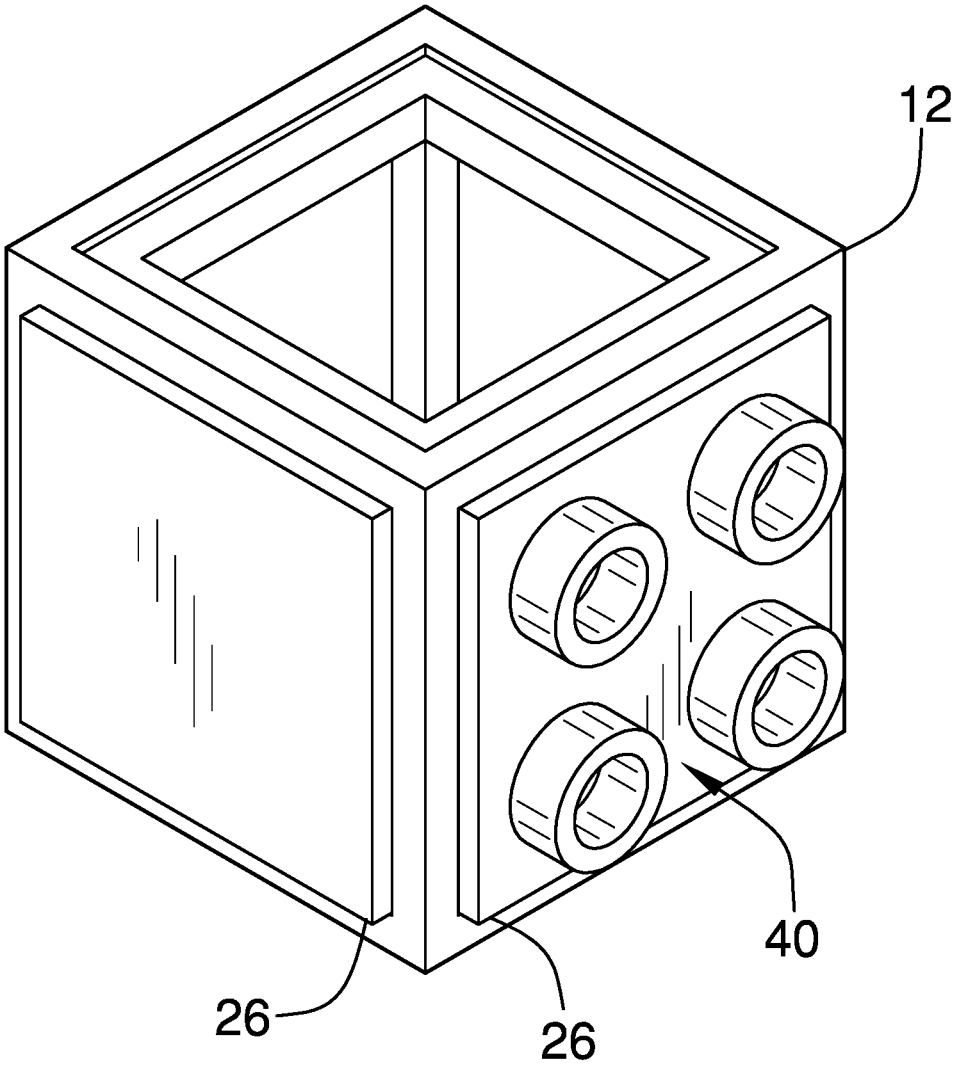
FIG. 15 is a front perspective view of an embodiment of the disclosure.
Figure 16:
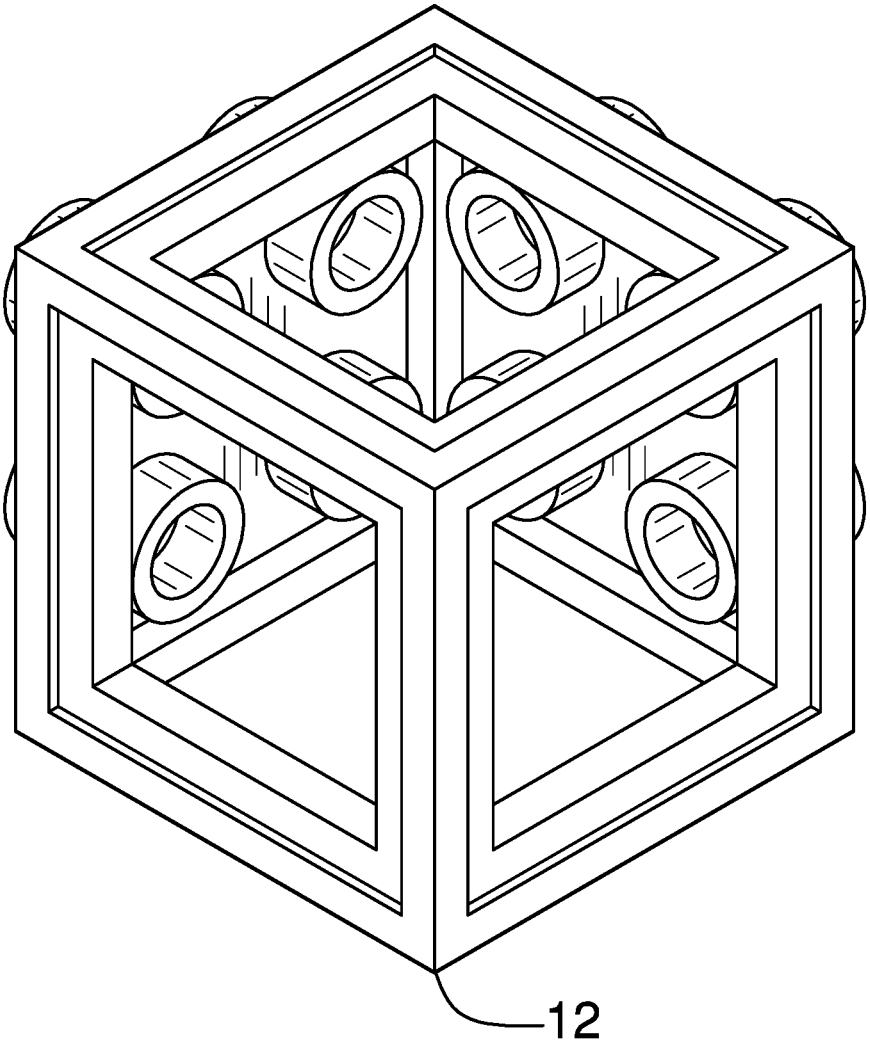
FIG. 16 is a rear perspective view of FIG. 15 of an embodiment of the disclosure.
Figure 17:
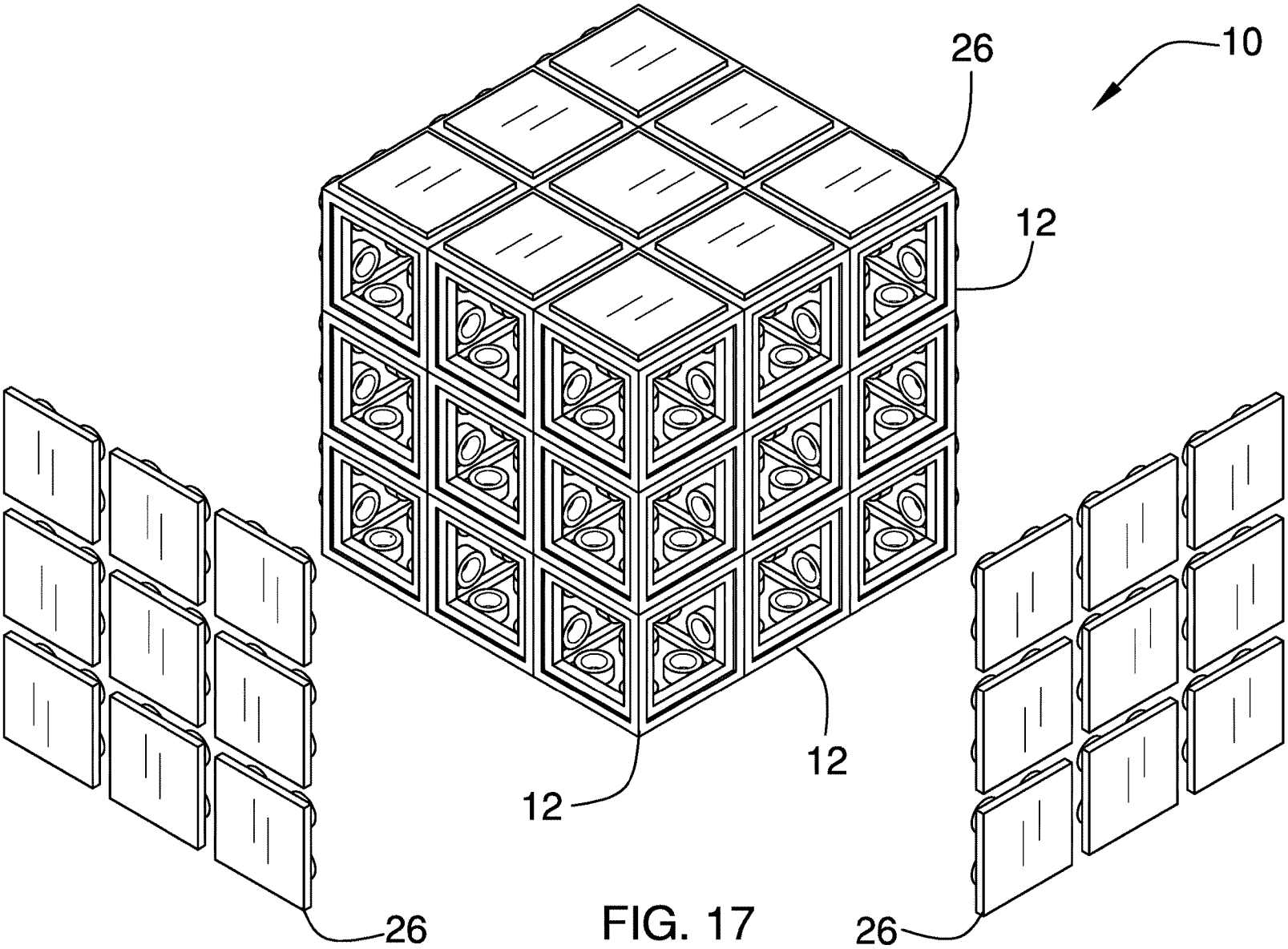
FIG. 17 is a partially exploded perspective view of an embodiment of the disclosure.

A plurality of male connectors 40 may be provided and attached to outer surfaces, or second sides 30, of the plurality of inserts 26 as shown in FIG. 5. However, as shown in FIG. 13, the outer surfaces 30 may be planar. The outer surface 30 of the plurality of inserts 26 having the male connectors 40, as shown in FIG. 5, will include at least one male connector 40 attached thereto and each of the male connectors 40 may comprise a plurality of male pegs 34. More specifically, each male connector 40 may include four male pegs 34. Thus, some of the inserts 26 will be reversible and some will not and furthermore some inserts 26 will include means for engaging other bricks opposite of the base brick to which they are first attached. This is best shown in FIGS. 15 and 16 wherein both types of inserts 26 are being utilized with a single base brick 12. FIG. 17 shows how inserts 26 having planar outer surfaces 30 may be positioned such that they encapsulate a plurality of base bricks 12 having inserts including male connectors 40 so that adjacent ones of the base bricks 12 may be coupled together.

Figure 18:
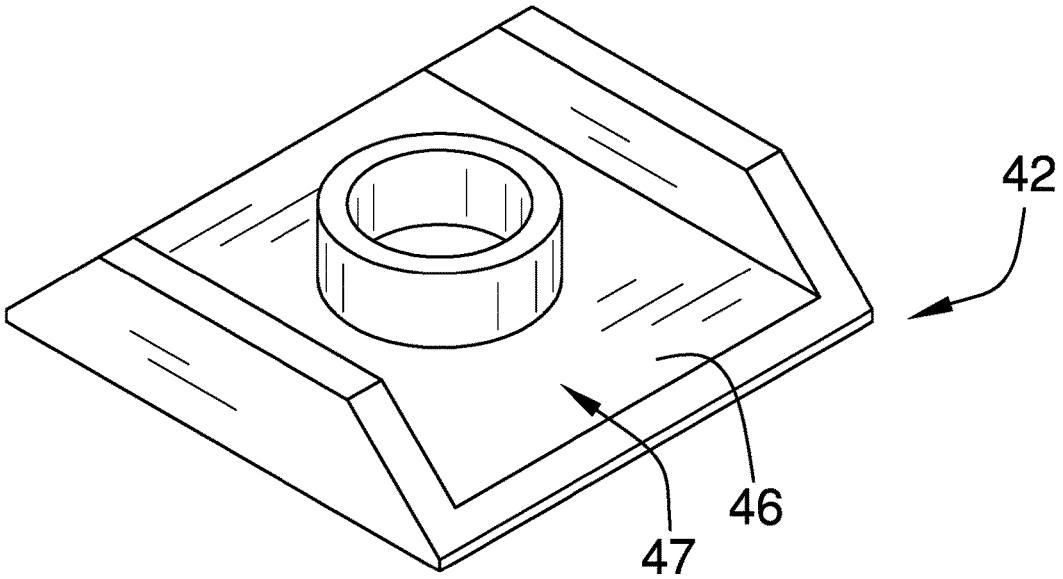
FIG. 18 is a bottom perspective view of a cover of an embodiment of the disclosure.
Figure 19:
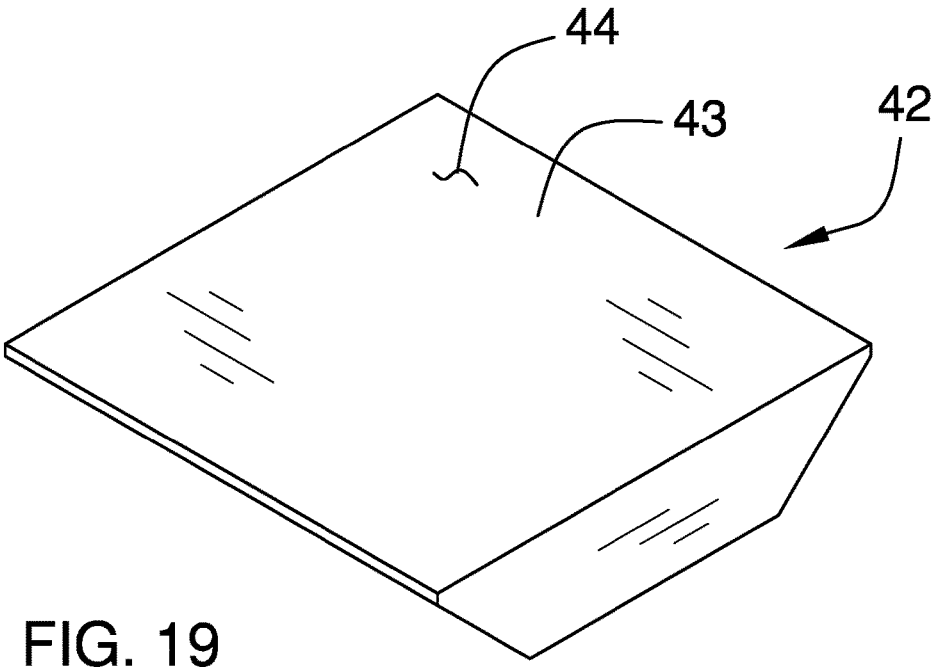
FIG. 19 is a top perspective view of an embodiment of FIG. 18 of the disclosure.
Figure 23:
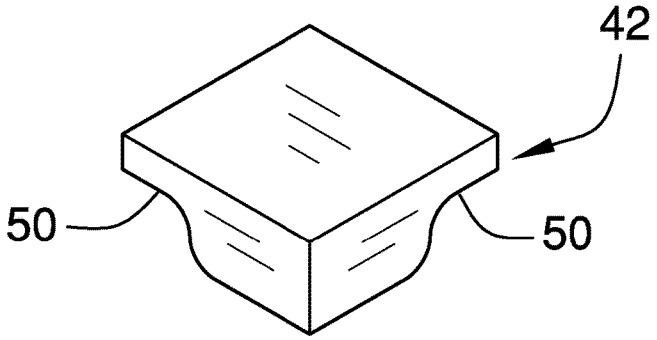
FIG. 23 is a top perspective view of a cover of an embodiment of the disclosure.
Figure 24:
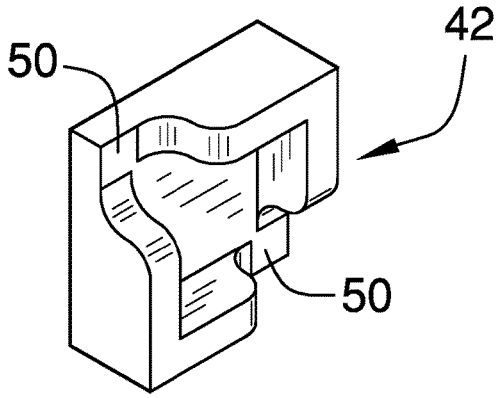
FIG. 24 is a bottom perspective view of FIG. 23 of the disclosure.
Figure 29:
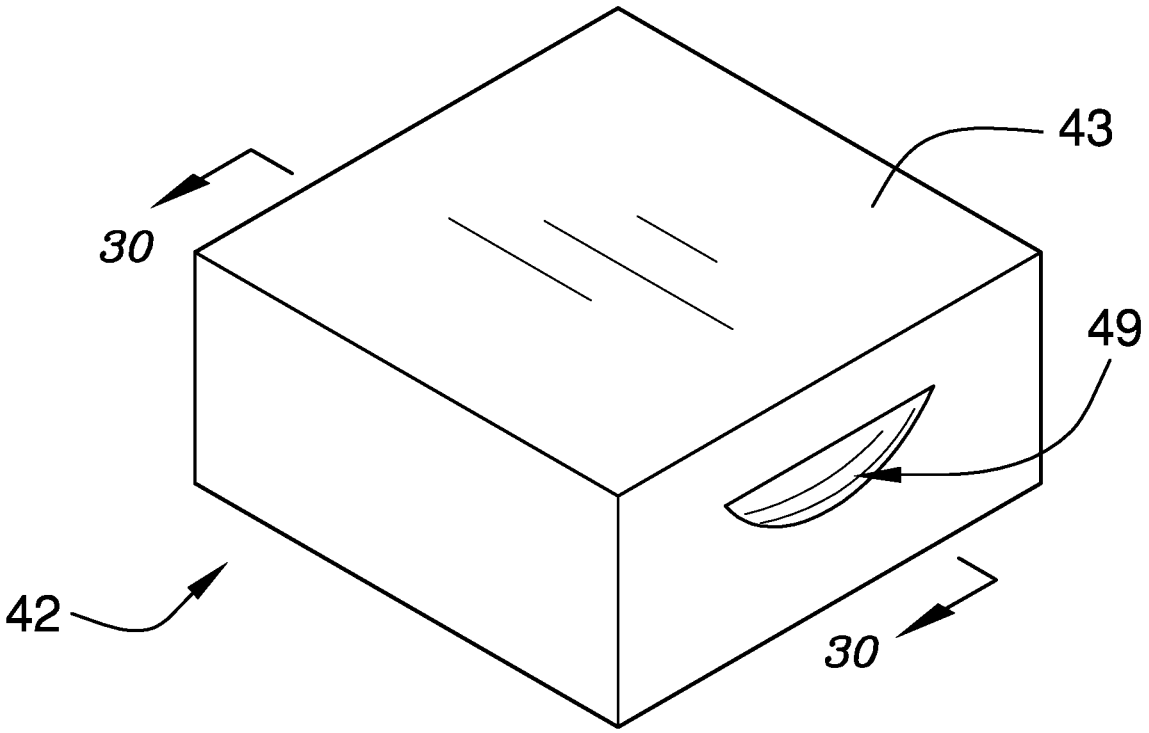
FIG. 29 is a top perspective view of an embodiment of a cover of the disclosure.
Figure 30:
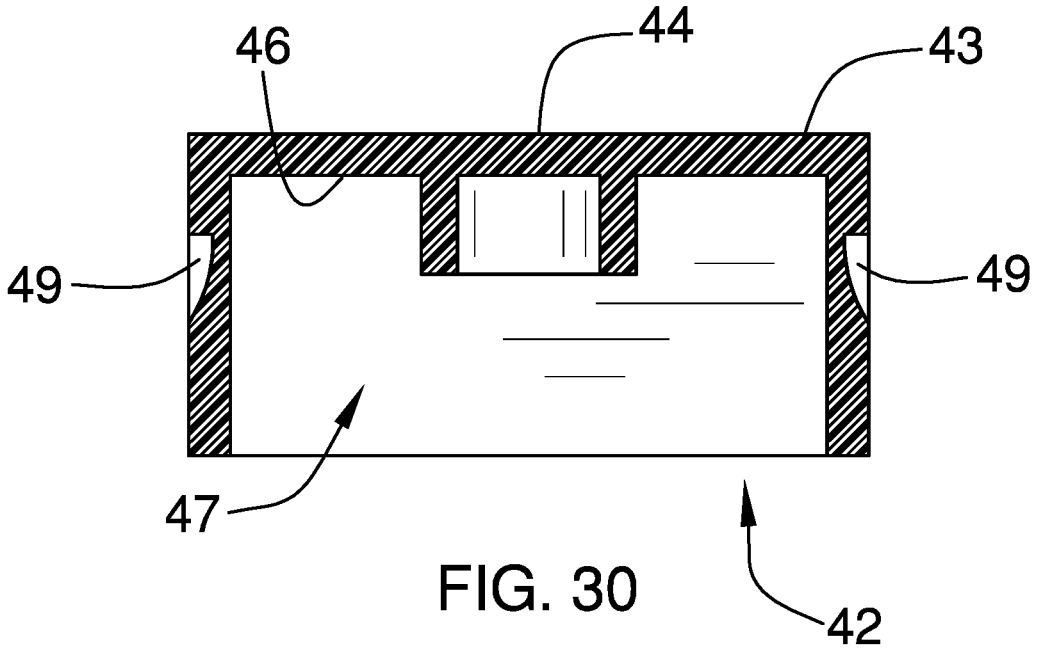
FIG. 30 is a cross-sectional view taken along line 30-30 of FIG. 29.
Figure 31:
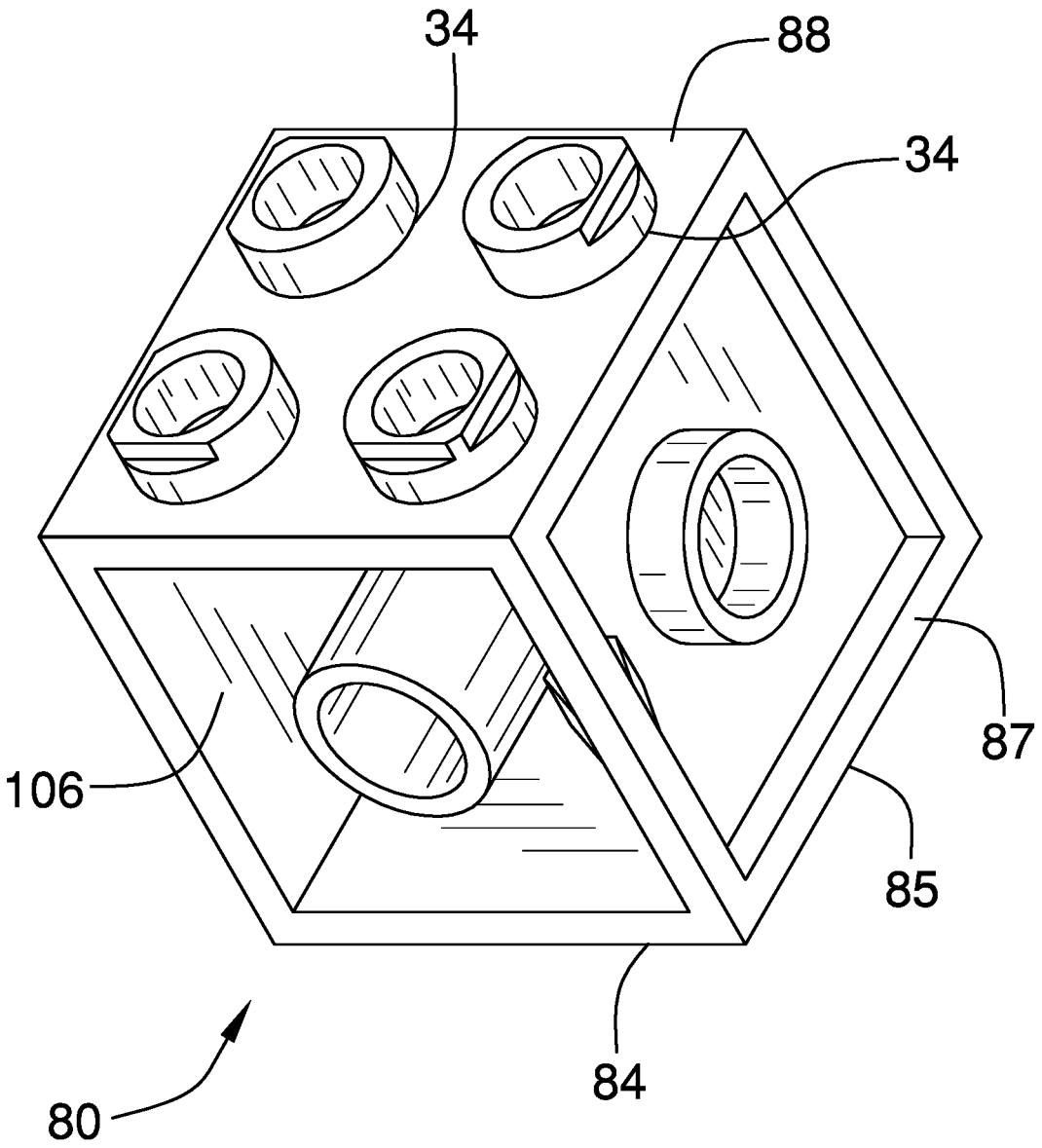
FIG. 31 is a bottom and right side perspective of a brick shown in FIG. 22 of the disclosure.
Figure 32:
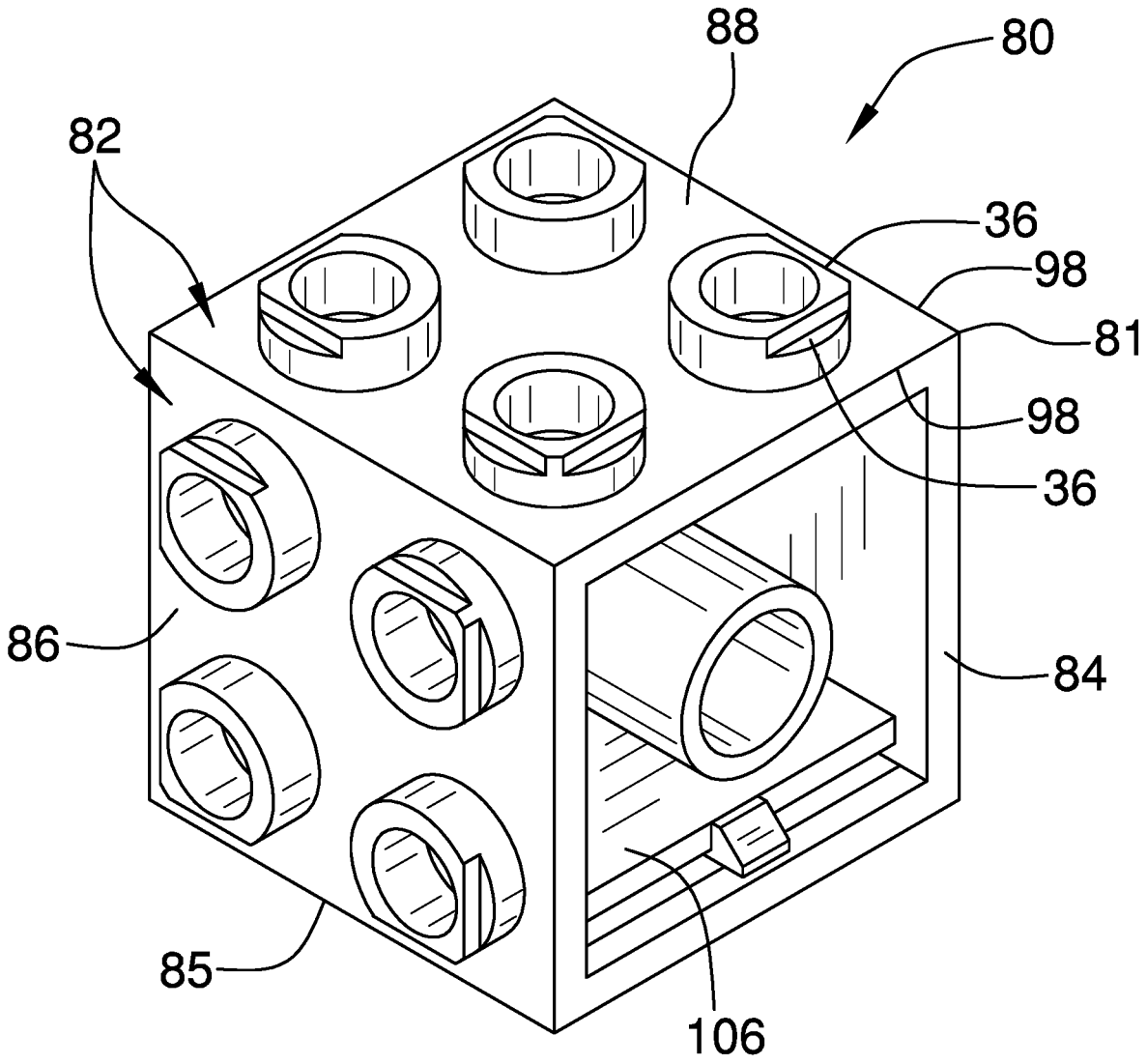
FIG. 32 is a bottom and left side perspective view of a brick shown in FIG. 22 of the disclosure.

The system 10 includes a plurality of covers 42, examples of which are found in FIGS. 18, 19, 23, 24, 29 and 30. Each of the covers 42 is removably attached to one of the male connectors 40. The covers 42 are positionable over and cover an associated one of the outer surfaces 30. Each of the covers 42 includes a rectangular member 43 having a first side 44 and a second side 46. The rectangular member 43 comprises a solid wall and the second sides 46 of the covers 42 each including a female connector 47 engageable with one of the male connectors 40. The female connector 47 includes a receiving space for receiving and frictionally engaging the male pegs 34 of the male connectors 40. FIGS. 18 and 19 include trapezoidal side walls and open sided ends for allowing a person to more easily grip the covers 42 to disengage them from the male connectors. FIG. 23 and FIG. 24 depict additional embodiments of the covers 42 having corner openings 50 therein. The embodiment in FIGS. 29 and 30 provide for a peripheral wall 48 having cutout 49 formed therein for gripping by a person's fingernail. The open sided ends, corner openings 50 and cutouts 49 all provide a gripping area to facilitate disengagement of the coves 42 from the male connectors 40/male pegs 34. It should be understood that each cover 42 may be sized to engage any selected amount of male pegs 34. The embodiment in FIG. 24 may best be suited for engagement with single male peg while that found in FIG. 18 might include any required size so that it would fit matrixes of 2×2 male pegs, 3×3 male pegs and the like. The first sides 44 of the covers 42 are completely planar meaning that they are without any structure extending upwardly therefrom.

Figure 9:
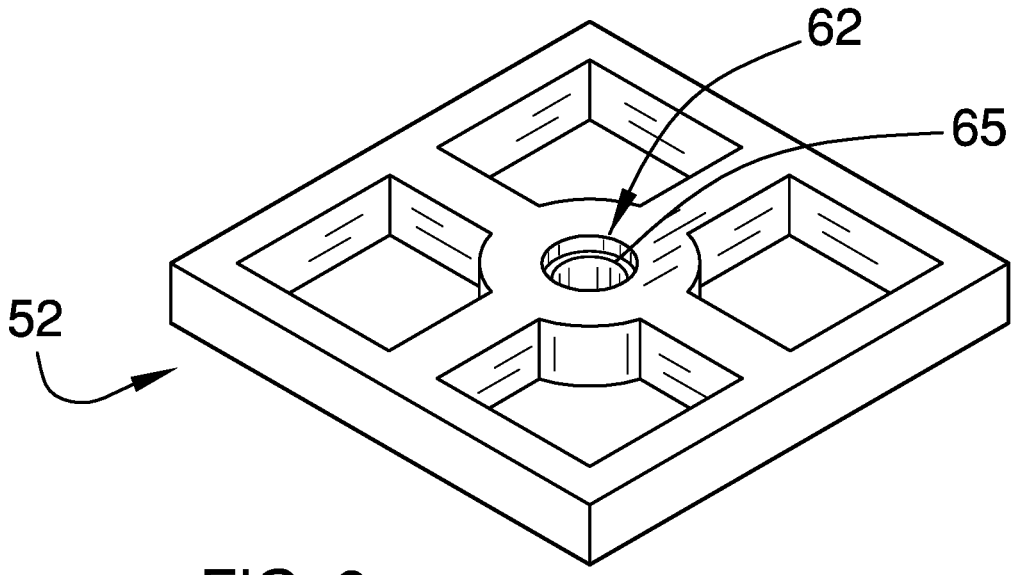
FIG. 9 is a top perspective view of an embodiment of the disclosure of an extension member including a rotational coupler connection.
Figure 10:
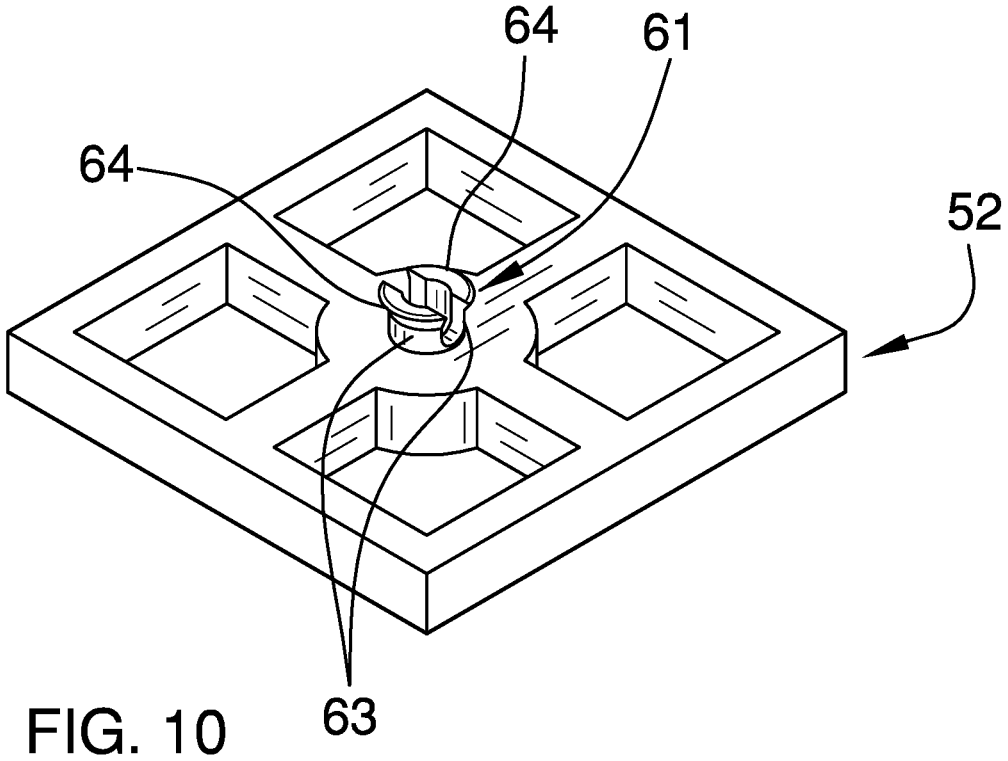
FIG. 10 is a top perspective view of an embodiment of the disclosure of an extension member including a rotational coupler connection.
Figure 11:
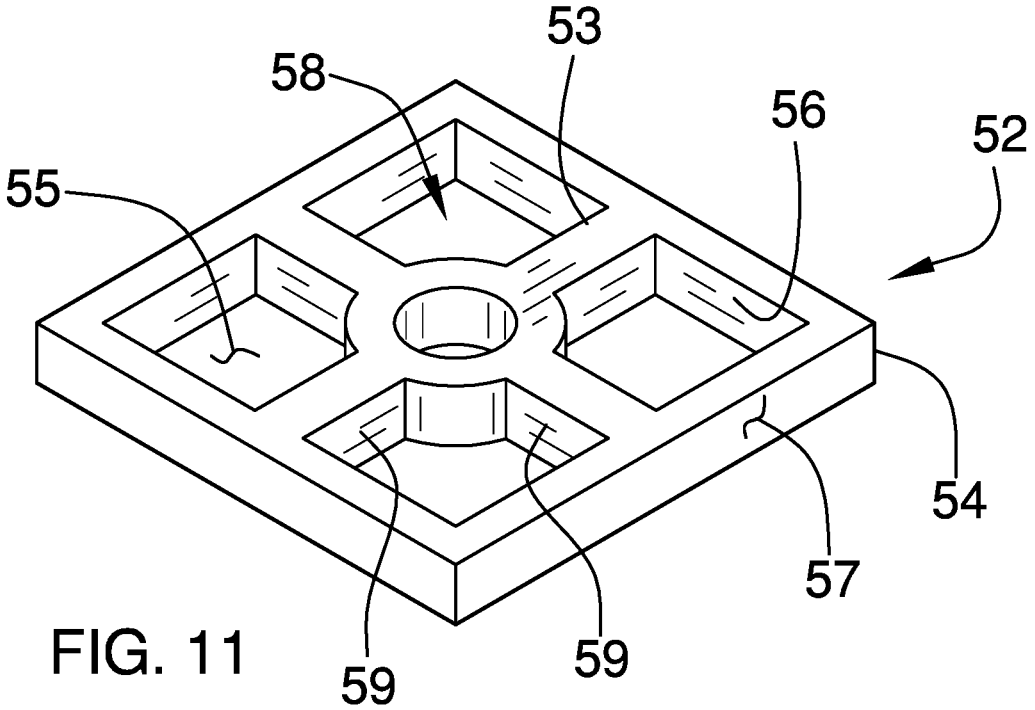
FIG. 11 is a top perspective view of an embodiment of an extension member of the disclosure.

FIGS. 9-12 depict various extenders 52 that are connectable with the inserts 26 to allow two inserts 26 to be coupled together. Each of the extenders 52 includes a frame 53 having an outer perimeter wall 54 bounding an inner space 55. The outer perimeter wall 54 has an interior surface 56 and an exterior surface 57. The interior surface 56 extends around an aperture 58 passing through the extender 52. Each of the male connectors 40 is removably receivable and engageable with one of the interior surfaces 56. The aperture 58 may be square shaped or substantially square shaped as is shown in FIG. 11. A pair of supports 59 traverses the aperture 58 and is attached to the interior surface 56. The supports 59 are orientated perpendicular to each other. As can be seen in FIGS. 9-12, the supports 59 divide the aperture 58 into four sub-openings 60 each positioned to receive a single male peg 34. In this manner, the extenders 52 allow two inserts 26 to be attached together. When multiple base bricks 12, inserts 26 and extenders 52 are used in conjunction with each other, the system 10 may be used to form various structures such as a cube. The extenders 52, particularly those of the type shown in FIG. 11, will typically have apertures having a depth equal to at least two times a height of the male pegs 34 but less than 2.5 times the height of the male pegs 34. The extenders 52 may also be used with all-male bricks 37 of the type found in FIG. 28 to allow two male bricks to be coupled together in close proximity to each other to simulate a cube shape as is being formed in FIG. 20. However, it should be understood that the structure of FIG. 20 may be comprised of all-female base bricks 12 including inserts 26 having outwardly extending male couplers 40 that are engaged with the extenders 52.

Figure 7:
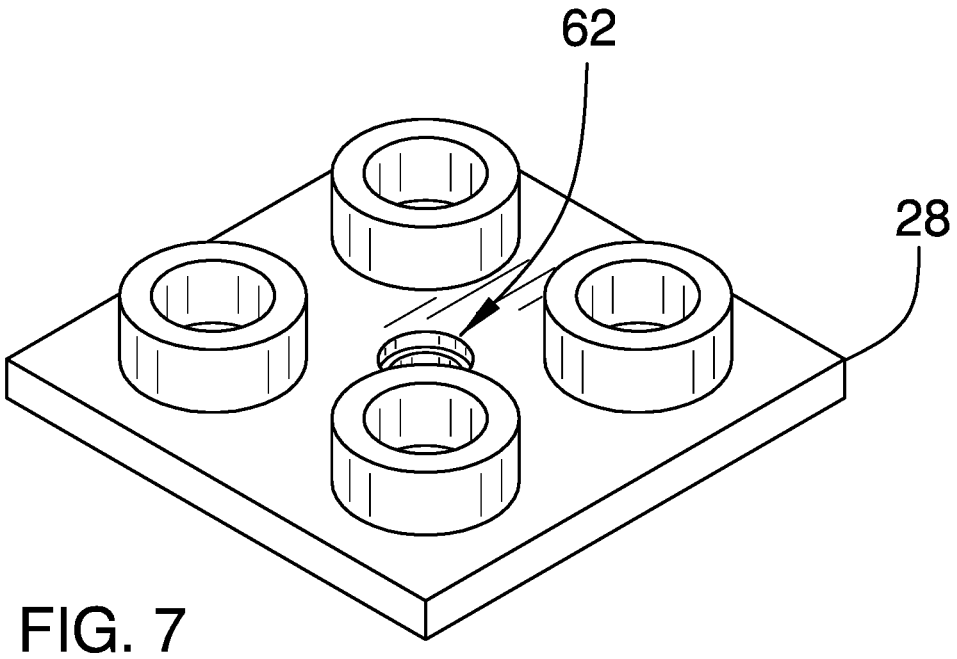
FIG. 7 is a top perspective view of an embodiment of the disclosure of an insert including a rotational coupler connection.
Figure 8:
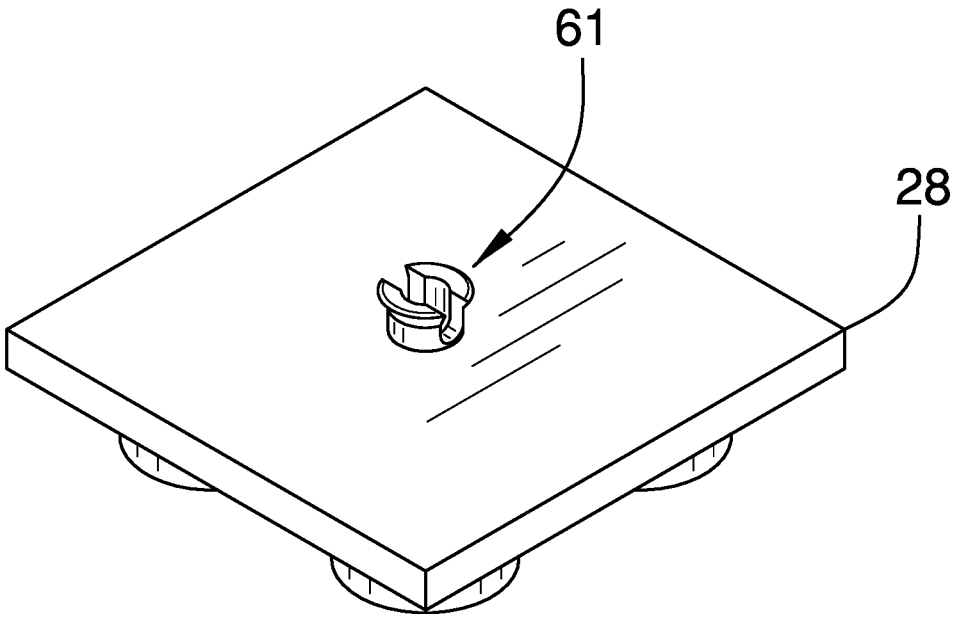
FIG. 8 is a top view of an embodiment of the disclosure of an insert including a rotational coupler connection.

While FIGS. 9 and 10 appear to have a similar depth as the extender of FIG. 11, these extenders 52 may only require a depth equal to at least the height of a male peg 34. These versions of the extenders 52 include rotational couplers. Each of rotational couplers includes a first mating member 61 and a second mating member 62. At least some of the extenders 52 has one of the first mating members 61 coupled thereto and at least some of the extenders 52 has one of the second mating members 62 coupled thereto. The first mating member 61 of one of the extenders 52 is removably engageable to the second mating member 62 of one of the extenders 52 to rotationally couple corresponding ones of the extenders 52 together. The corresponding ones of the extenders 52 has a rotational axis orientated and aligned with an axis of associated ones of the apertures 58. The first 61 and second 62 mating members may also be found on inserts 26 as shown in FIGS. 7 and 8. The rotational couplers allow pairs of the inserts 26 and/or pairs of extenders to be rotationally coupled together as well as inserts 26 rotationally coupled to extenders 52. The first mating member 61 may include a pair of arms 63 each having a free end including a flange 64. The arms 63 are extendable into the second mating member 62 and the flanges 64 insertable into an annular slot 65 positioned within the second mating member 62 to allow the flanges 64 to engage and rotate with respect to the second mating member 62.

Figure 12:
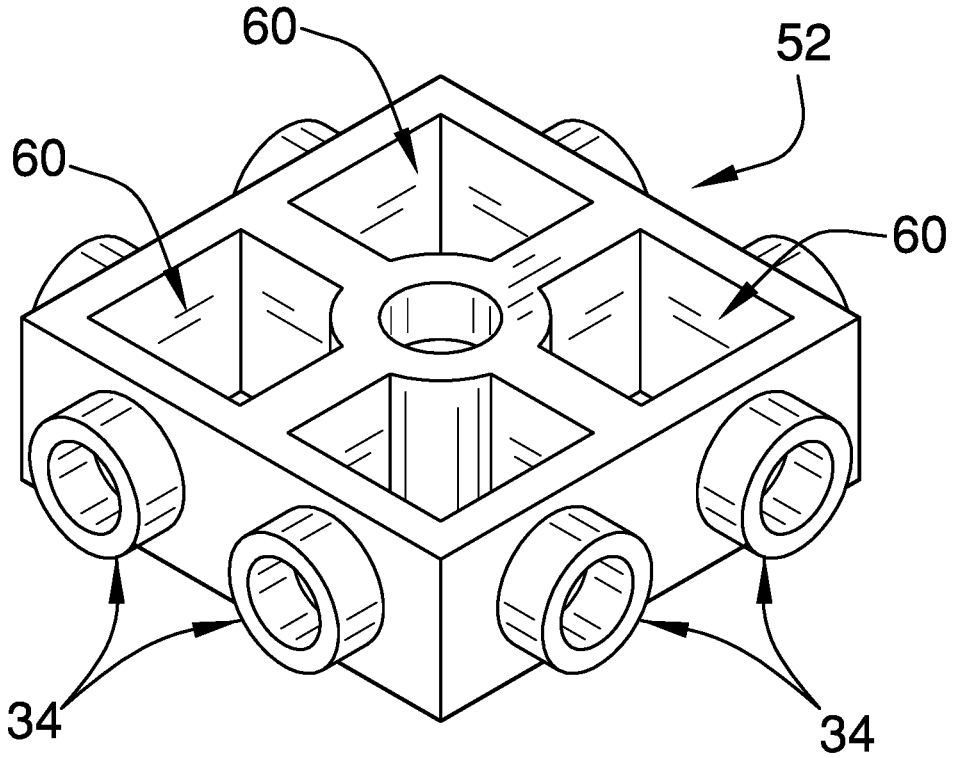
FIG. 12 is a top perspective view of an embodiment of an extension member of the disclosure.

FIG. 12 provides for an extender 52 having a peripheral edge including male pegs 34 for engagement with other bricks. The male pegs 34 shown in FIG. 12 include two male pegs 34 positioned on each independent side of the peripheral edge wherein the peripheral edge includes four independent sides. However, only two oppositely positioned ones of the independent sides may include male pegs 34.

Figure 20:
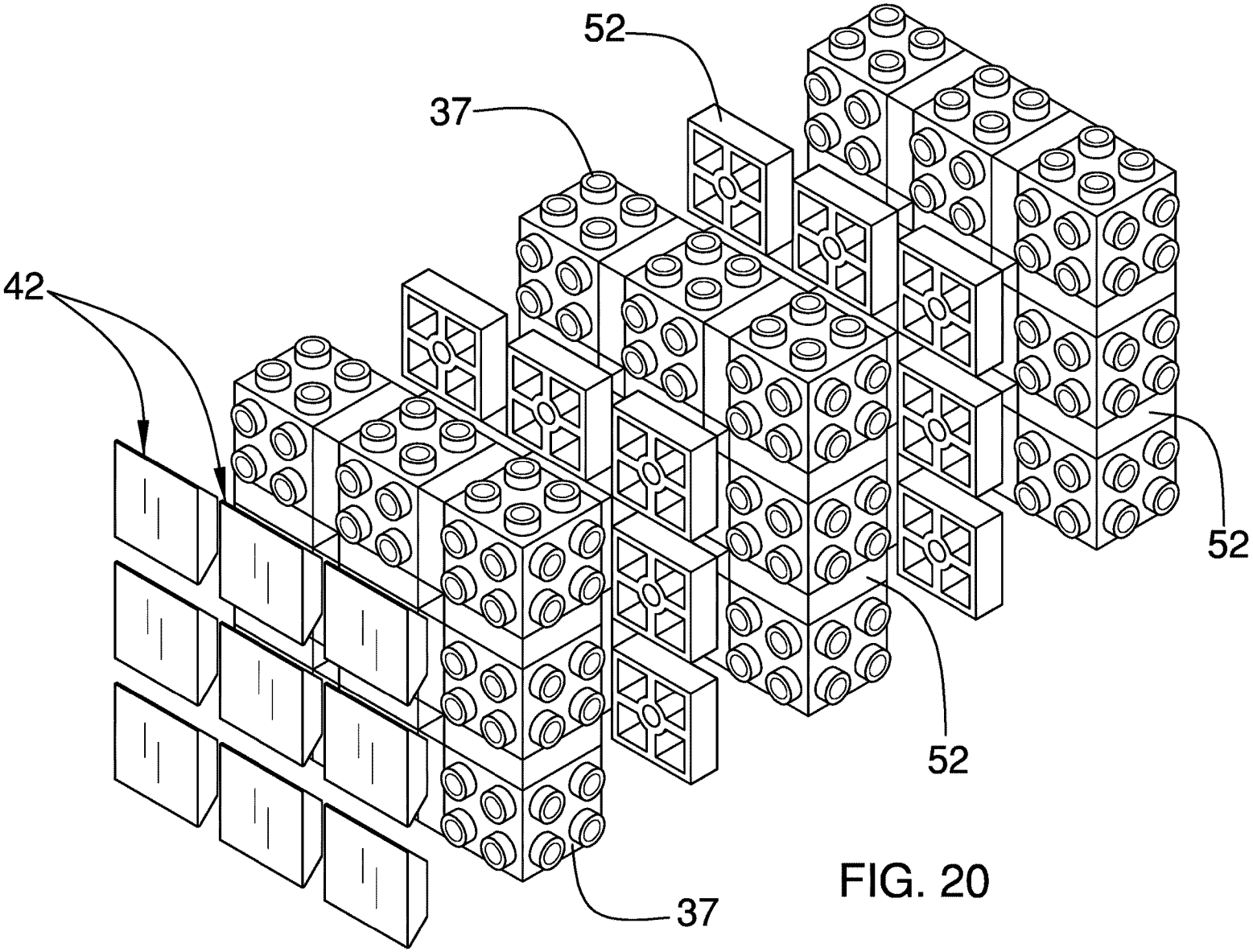
FIG. 20 is an exploded perspective view of an embodiment of the disclosure.
Figure 21:
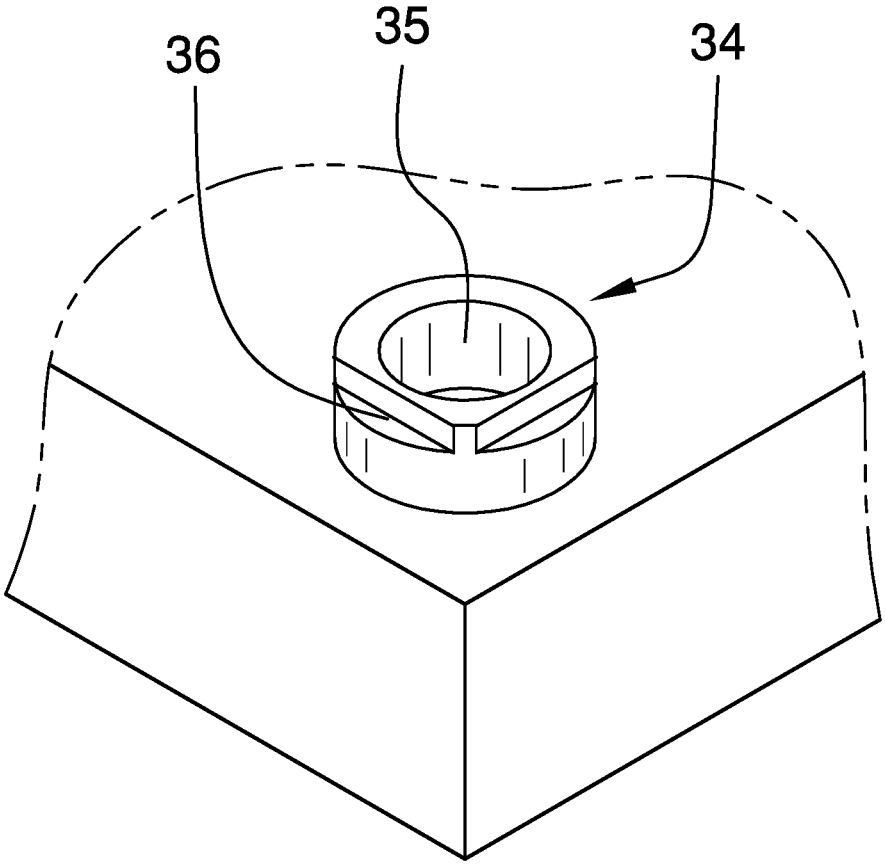
FIG. 21 is a perspective view of a male peg of an embodiment of the disclosure.

In use, the system 10 allows a person to utilize all-female building bricks, represented by the base bricks 12, to construct arrangements not previously allowed by way of conventional toy brick assemblies. The user may use the inserts 26 to simply cover the female receivers 15, attach covers 42 to the base bricks 12 or, by utilizing the extenders 52, to connect base bricks 12 together. As can be seen in FIGS. 17 and 20, this structure allows the user of the system 10 to build in all directions simultaneously and to build cubic structures not available with other toy brick assemblies. The covers 53 provide for pleasing aesthetics and may be colored multiple colors to allow personal tailoring of structures created with the system 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toy building brick comprising:

a brick having an outer surface, said outer surface including a plurality of outer walls;

a male peg being attached to one of said outer walls, said male peg being configured to engage a female connector, said male peg including;

a post having a terminal end, said terminal end having an outer peripheral edge;

said outer peripheral edge having a notch positioned therein; and said notch extending into said post from said terminal end and facing an adjacent edge of the outer wall attached to said male peg such that said notch defines a first exposed planar face extending uninterrupted fully across said post parallel to said adjacent edge of said outer wall attached to said male peg and a second exposed planar face extending uninterrupted fully across said post perpendicular to said first planar face, each of said first exposed planar face and said second exposed planar face having a respective free edge opposite a junction of said first exposed planar face and said second exposed planar face.

2. The toy building brick according to claim 1, wherein said outer surface includes a plurality of outer walls, said outer walls including an upper wall, a lower wall, and a side wall extending between said upper and lower walls.

3. The toy building brick according to claim 2, wherein said side wall including a front wall, a rear wall, a first lateral wall and a second lateral wall.

4. The toy building brick according to claim 1, wherein said brick has a length, width and height each being less than 3.0 inches.

5. The toy building brick according to claim 1, wherein at least one of said outer surfaces comprises a female connector configured to engage a plurality of male pegs from another toy building brick.

6. A toy building brick comprising:

a brick having an outer surface, said outer surface including a plurality of outer walls;

a plurality of male pegs being attached to at least one of said outer walls, said male pegs being configured to engage a female connector, each of said male pegs including;

a post having a terminal end, said terminal end having an outer peripheral edge;

said outer peripheral edge having a notch positioned therein, said notch extending into said post from said terminal end and facing an adjacent edge of the outer wall attached to said male peg such that said notch defines a first exposed planar face extending uninterrupted fully across said post parallel to said adjacent edge of said outer wall attached to said male peg and a second exposed planar face extending uninterrupted fully across said post perpendicular to said first planar face, each of said first exposed planar face and said second exposed planar face having a respective free edge opposite a junction of said first exposed planar face and said second exposed planar face.

7. The toy building brick according to claim 6, wherein at least one of said outer surfaces comprises a female connector configured to engage a plurality of male pegs from another toy building brick.

8. The toy building brick according to claim 7, wherein said outer surface includes a plurality of outer walls, said outer walls including an upper wall, a lower wall, and a side wall extending between said upper and lower walls.

9. The toy building brick according to claim 8, wherein said side wall including a front wall, a rear wall, a first lateral wall and a second lateral wall.

10. The toy building brick according to claim 9, wherein said brick has a length, width and height each being less than 3.0 inches.

11. A toy building brick comprising:

a brick having an outer surface, said outer surface including a plurality of outer walls;

a plurality of male pegs being attached to at least one of said outer walls, said male pegs being configured to engage a female connector, each of said male pegs including;

a post having a terminal end, said terminal end having an outer peripheral edge; and said outer peripheral edge having a pair of notches positioned therein, each said notch extending into said post from said terminal end and each said notch facing a respective adjacent edge of the outer wall attached to said male peg such that each said notch defines a respective first exposed planar face extending uninterrupted fully across said post parallel to said respective adjacent edge of said outer wall attached to said male peg and a respective second exposed planar face extending uninterrupted fully across said post perpendicular to said respective first planar face, each of said first exposed planar face and said second exposed planar face of each said notch having a respective free edge opposite a junction of said first exposed planar face and said second exposed planar face of each said notch.

12. The toy building brick according to claim 11, wherein said outer walls includes an upper wall, a lower wall, and a side wall extending between said upper and lower walls, said side wall including a front wall, a rear wall, a first lateral wall and a second lateral wall.

13. The toy building brick according to claim 12, wherein said brick has a length, width and height each being less than 3.0 inches.

14. The toy building brick according to claim 11, wherein:

said surface having said male pegs thereon has a rectangular shape and includes four corners;

wherein each of said male pegs further includes:

one of said notches facing one of a first edge of a pair of adjacent edges of one of said corners, one of said notches facing a second edge of said pair of adjacent edges, wherein each of said first and second adjacent edges corresponds with one of said notches.

15. The toy building brick according to claim 11, wherein at least one of said outer surfaces comprising a female connector configured to engage a plurality of male pegs from another said toy building brick.

16. The toy building brick according to claim 15, wherein said outer walls includes an upper wall, a lower wall, and a side wall extending between said upper and lower walls, said side wall including a front wall, a rear wall, a first lateral wall and a second lateral wall.

17. The toy building brick according to claim 16, wherein said brick has a length, width and height each being less than 3.0 inches.

18. The toy building brick according to claim 17, wherein:

said surface having said male pegs thereon has a rectangular shape and includes four corners;

wherein each of said male pegs further includes:

one of said notches facing one of a first edge of a pair of adjacent edges of one of said corners, one of said notches facing a second edge of said pair of adjacent edges, wherein each of said first and second adjacent edges corresponds with one of said notches.

19. The toy building brick according to claim 18, wherein said plurality of male pegs comprises four male pegs, each said corner of said four corners having one of said pegs positioned adjacent thereto.

20. The toy building brick according to claim 15, wherein:

said surface having said male pegs thereon has a rectangular shape and includes four corners; and wherein each of said male pegs further includes:

one of said notches facing one of a first edge of a pair of adjacent edges of one of said corners, one of said notches facing a second edge of said pair of adjacent edges, wherein each of said first and second adjacent edges corresponds with one of said notches.

* * * * *